US010580257B2

(12) United States Patent
Berman et al.

(10) Patent No.: US 10,580,257 B2
(45) Date of Patent: Mar. 3, 2020

(54) SYSTEMS, APPARATUSES AND METHODS FOR ENHANCING PROGRESSIVE AWARDS IN GAMING ACTIVITIES

(71) Applicant: KING SHOW GAMES, INC., Minnetonka, MN (US)

(72) Inventors: Bradley Berman, Minnetonka, MN (US); Anthony Rath, Minnetonka, MN (US)

( * ) Notice: Subject to any disclaimer, the term of this patent is extended or adjusted under 35 U.S.C. 154(b) by 0 days.

(21) Appl. No.: 15/805,324

(22) Filed: Nov. 7, 2017

(65) Prior Publication Data

US 2018/0130301 A1 May 10, 2018

Related U.S. Application Data

(60) Provisional application No. 62/419,441, filed on Nov. 8, 2016.

(51) Int. Cl.
*G07F 17/32* (2006.01)
*G07F 17/34* (2006.01)

(52) U.S. Cl.
CPC ..... *G07F 17/3258* (2013.01); *G07F 17/3209* (2013.01); *G07F 17/3225* (2013.01); *G07F 17/34* (2013.01)

(58) Field of Classification Search
CPC ..... A63F 2003/0017
See application file for complete search history.

(56) References Cited

U.S. PATENT DOCUMENTS

| | | | | |
|---|---|---|---|---|
| 8,449,387 | B2 | 5/2013 | Englman et al. | |
| 8,506,391 | B2 | 8/2013 | Jaffe et al. | |
| 8,506,392 | B2 | 8/2013 | Jaffe | |
| 8,628,410 | B2 | 1/2014 | Jaffe et al. | |
| 9,355,521 | B2 | 5/2016 | King | |
| 2005/0059481 | A1* | 3/2005 | Joshi | G07F 17/3211 463/27 |
| 2005/0239542 | A1 | 10/2005 | Olsen | |
| 2006/0287036 | A1* | 12/2006 | Daly | G07F 17/3211 463/16 |
| 2007/0105619 | A1* | 5/2007 | Kniesteadt | G07F 17/32 463/26 |
| 2007/0218982 | A1* | 9/2007 | Baerlocher | G07F 17/32 463/27 |

* cited by examiner

*Primary Examiner* — Kevin Y Kim

(57) ABSTRACT

Gaming systems, apparatuses and methods for providing a progressive jackpot(s) with must-hit functionality and non-resetting progressive jackpots. Awards that increase in value over time, such as progressive awards/jackpots, may be enhanced by establishing conditions in which such progressive awards are guaranteed to be paid to players, and establishing conditions in which such progressive awards will continue to increase in value notwithstanding payout of such progressive awards.

16 Claims, 8 Drawing Sheets

SYSTEMS, APPARATUSES AND METHODS FOR ENHANCING PROGRESSIVE AWARDS IN GAMING ACTIVITIES

FIELD

This disclosure relates generally to games, and more particularly to systems, apparatuses and methods for enhancing progressive awards in gaming activities.

BACKGROUND

Casino games such as poker, slots, and craps have long been enjoyed as a means of entertainment. Some of these games originated using traditional elements such as playing cards or dice. More recently, gaming devices have been developed to simulate and/or further enhance these games while remaining entertaining. The popularity of casino gambling with wagering continues to increase, as does recreational gambling such as non-wagering computer game gambling. Part of this popularity is due to the increased development of new types of games that are implemented, at least in part, on gaming devices.

One reason that casino games are widely developed for gaming devices is that a wide variety of games can be implemented on gaming devices, thereby providing an array of choices for players looking to gamble. For example, the graphics and sounds included in such games can be modified to reflect popular subjects, such as movies and television shows. Game play rules and types of games can also vary greatly providing many different styles of gambling. Additionally, gaming devices require minimal supervision to operate on a casino floor, or in other gambling environments. That is, as compared to traditional casino games that require a dealer, banker, stickman, pit managers, etc., gaming devices need much less employee attention to operate.

With the ability to provide new content, players have come to expect the availability of an ever wider selection of new games when visiting casinos and other gaming venues. Playing new games adds to the excitement of "gaming." As is well known in the art and as used herein, the term "gaming" and "gaming devices" generally involves some form of wagering, and that players make wagers of value, whether actual currency or something else of value, e.g., token or credit. Wagering-type games usually provide rewards based on random chance as opposed to skill, although some skill may be an element in some types of games. Since random chance is a significant component of these games, they are sometimes referred to as "games of chance."

The present disclosure describes systems, apparatuses and methods that facilitate new and interesting gaming experiences, and provide advantages over the prior art.

SUMMARY

The present disclosure is directed to systems, apparatuses, computer-readable media, and/or methods that are configured to enhance payouts or other awards in gaming activities. Awards that increase in value over time, such as progressive awards/jackpots, may be enhanced by establishing conditions in which such progressive awards are guaranteed to be paid to players, and establishing conditions in which such progressive awards will continue to increase in value notwithstanding payout of such progressive awards.

In one embodiment, a slot game apparatus is provided, that includes one or more displays, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to establish a monetary threshold where a progressive jackpot is guaranteed to be awarded at or below the monetary threshold, to cause the progressive jackpot to be awarded at a monetary value at or below the monetary threshold, and when the progressive jackpot has been awarded below the monetary threshold, to maintain the progressive jackpot at its current monetary level and enable the progressive jackpot to continue to increase in value.

In a more particular embodiment of such a slot game apparatus, the processor is further configured to reset the progressive jackpot to a reset value in response to the progressive jackpot being awarded when the value of the progressive jackpot has exceeded the monetary threshold where the progressive jackpot is guaranteed to be awarded.

In another embodiment, the processor is configured to cause the progressive jackpot to be awarded at the monetary value by comparing a game play variable to a predetermined condition, and by causing the progressive jackpot to be awarded if the game play variable satisfies the predetermined condition. In another embodiment, the predetermined condition includes a randomly-determined number of slot game events played, within a predetermined range of slot game events played, since a last award of the progressive jackpot. The game play variable includes a current number of the slot game events played since the last award of the progressive jackpot. The processor is configured to cause the progressive jackpot to be awarded at the monetary value in response to the current number of slot game events played corresponding to the randomly-determined number of slot game events played. In yet another embodiment, the predetermined condition includes a randomly-determined progressive jackpot value within a predetermined range of progressive jackpot values, and the game play variable includes a current progressive jackpot value. The processor is configured to cause the progressive jackpot to be awarded at the randomly-determined progressive jackpot value in response to the current progressive jackpot value reaching the randomly-determined progressive jackpot value. In still another embodiment, the predetermined condition is an award date and time, the game play variable corresponds to the current date and time, and the processor is configured to cause the progressive jackpot to be awarded at the current date and time in response to the current date and time corresponding to the award date and time.

In still other embodiments, the slot game apparatus further involves providing the monetary value to the player in response to the causing of the progressive jackpot to be awarded. In another embodiment, the processor is configured to cause the progressive jackpot to be awarded by causing the progressive jackpot to be awarded at or below the monetary threshold as a consequence of guaranteeing the progressive jackpot be awarded at or below the monetary threshold.

In another embodiment of such a slot game apparatus, the processor is further configured to determine when the progressive jackpot has been awarded above the monetary threshold, and to reset the progressive jackpot to a new monetary value that is lower than the monetary value at the time that the progressive jackpot was awarded above the monetary threshold. In a more particular embodiment, the new monetary value is a fixed monetary value that is less than the monetary value at the time that the progressive jackpot was awarded above the monetary threshold, while in another particular embodiment the new monetary value is a variable monetary value that is less than the monetary value at the time that the progressive jackpot was awarded above the monetary threshold.

In accordance with another embodiment, a slot game device is provided that includes one or more displays, a user interface, a wager input device, and a processor. The display presents a plurality of symbol locations forming a symbol array. The user interface includes a user input to enable a player to initiate a slot game event presented via the symbol array. The wager input device is structured to identify and validate player assets, and to permit the player to play the slot game event when the player assets are provided. The processor is configured to provide a progressive jackpot(s) that increases in value as the slot game events are played, establish a condition(s) where the progressive jackpot is guaranteed to be awarded, cause the progressive jackpot to be awarded upon satisfaction of the condition, and enable the progressive jackpot to be awarded in response to triggering incidents during play of the slot game events. When the progressive jackpot has been awarded in response to the triggering incidents during play of the slot game events, the processor is configured to maintain the progressive jackpot at its current value, and to enable the progressive jackpot to continue to increase in value.

In a more particular embodiment of such a slot game device, the processor is further configured to reset the progressive jackpot to a reset value in response to the processor causing the progressive jackpot to be awarded upon satisfaction of the condition.

In one embodiment, the processor is configured to establish the condition as a randomly-determined number of slot game events played, within a predetermined range of slot game events played, since a last award of the progressive jackpot, and to cause the progressive jackpot to be awarded in response to determining that a current number of slot game events played since a last award of the progressive jackpot has reached the randomly-determined number of slot game events played since the last award of the progressive jackpot. An alternative embodiment involves the processor being configured to establish the condition as a randomly-determined progressive jackpot value within a predetermined range of progressive jackpot values, and to cause the progressive jackpot to be awarded in response to determining that the current value of the progressive jackpot has reached the randomly-determined progressive jackpot value. Another alternative embodiment involves the processor being configured to establish the condition as an award date and time, and to cause the progressive jackpot to be awarded in response to determining that a current date and time has reached the award date and time.

In yet another embodiment of such a slot game device, the processor is configured to provide a plurality of distinct ones of the progressive jackpots, each of which increase in value as the slot game events are played.

This summary serves as an abbreviated, selective introduction of a representative subset of various concepts and embodiments that are further described or taught to those skilled in the art in the Specification herein. This summary is not intended to refer to all embodiments, scopes, or breadths of claims otherwise supported by the Specification, nor to identify essential features of the claimed subject matter, nor to limit the scope of the claimed subject matter.

DETAILED DESCRIPTION

Figure 1:
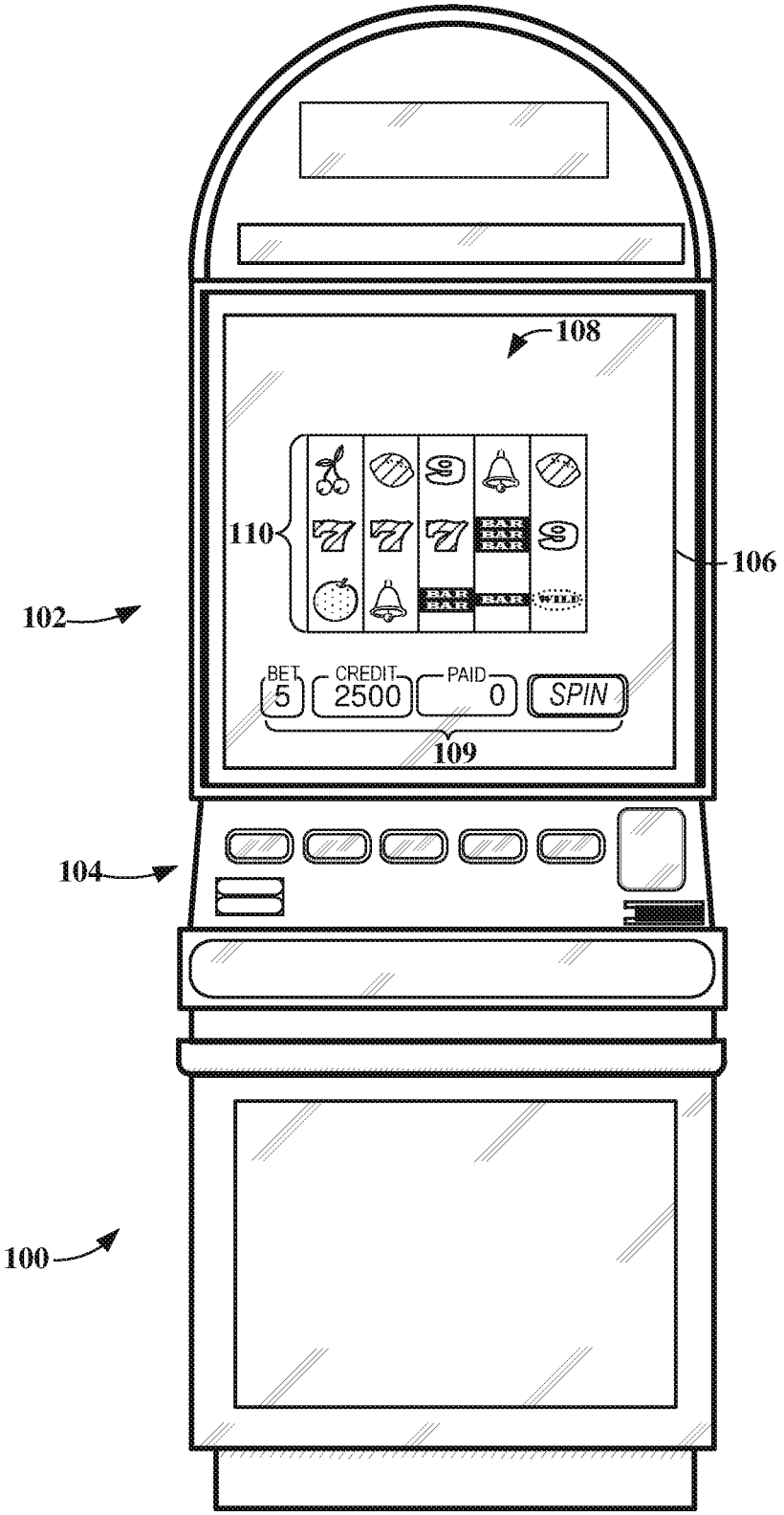
FIG. 1 is a diagram of a representative gaming machine capable of facilitating player use and interaction with games and features in accordance with the disclosure and representative embodiments described herein.

In the following description of various exemplary embodiments, reference is made to the accompanying drawings which form a part hereof, and in which is shown by way of illustration representative embodiments in which the features described herein may be practiced. It is to be understood that other embodiments may be utilized, as structural and operational changes may be made without departing from the scope of the disclosure.

In the description that follows, the terms "reels," "cards," "decks," and similar mechanically descriptive language may be used to describe various apparatus presentation features, as well as various actions occurring to those objects (e.g., "spin," "draw," "hold," "bet"). Although the present disclosure may be applicable to manual, mechanical, and/or computerized embodiments, as well as any combination therebetween, the use of mechanically descriptive terms is not meant to be only applicable to mechanical embodiments. Those skilled in the art will understand that, for purposes of providing gaming experiences to players, mechanical elements such as cards, reels, and the like may be simulated on a display in order to provide a familiar and satisfying experience that emulates the behavior of mechanical objects, as well as emulating actions that occur in the non-computerized games (e.g., spinning, holding, drawing, betting). Further, the computerized version may provide the look of mechanical equivalents but may be generally randomized in a different way. Thus, the terms "cards," "decks," "reels," "hands," etc., are intended to describe both physical objects and emulation or simulations of those objects and their behaviors using electronic apparatuses.

In various embodiments, the gaming displays are described in conjunction with the use of data in the form of "symbols." In the context of this disclosure, a "symbol" may generally refer at least to a collection of one or more arbitrary indicia or signs that have some conventional or defined significance. In particular, the symbol may represent values that can at least be used to determine whether to award a payout. A symbol may include numbers, letters, shapes, pictures, textures, colors, sounds, etc., and any combination therebetween. A play state, such as a win, can be determined by comparing the symbol with one or more other symbols. Such comparisons can be performed, for example, via software by mapping numbers (or other data structures such as character strings) to the symbols and performing the comparisons on the numbers/data structures. Other conventions associated with known games (e.g., the numerical value/ordering of face cards and aces in card games) may also be programmatically analyzed to determine winning combinations.

Generally, systems, apparatuses and methods are described for enhancing awards in gaming activities, such as providing new and/or improved manners of managing progressive awards such as progressive jackpots that increase in value over time for any reason, including continued play by players and allocating a portion of the players' bets to the progressive awards.

The systems, apparatuses and methods described herein may be implemented as a single game, or part of a multi-part game. For example, the game features described herein may be implemented in primary gaming activities, bonus games, side bet games or other secondary games associated with a primary gaming activity. The game features may be implemented in stand-alone games, multi-player games, etc. Further, the disclosure may be applied to games of chance, and descriptions provided in the context of any representative game (e.g. slot game) is provided for purposes of facilitating an understanding of the features described herein. However, the principles described herein are equally applicable to any game of chance where an outcome(s) is determined for use in the player's gaming activity. The progressive jackpots and other awards described herein may be established for play by single or multiple players in any desired configuration, such as, for example, as stand-alone progressive jackpots available to a single player on a gaming device, multiple players via local or wide area networks, etc.

Embodiments of the present concept include providing gaming devices (also referred to as gaming apparatuses or gaming machines), gaming systems, and methods of operating these devices or systems to provide game play that involves providing a progressive jackpot(s) with must-hit functionality and non-resetting progressive jackpots.

Numerous variations are possible in view of these and other embodiments of the inventive concept. Representative embodiments and variations are described herein, with some embodiments described with reference to the drawings. However, many other embodiments and variations exist that are covered by the principles and scope of this concept. For example, although some of the embodiments discussed below involve reel-based slot machine examples of this concept, other embodiments include application of these inventive techniques in other types of slot games, poker games, roulette, bingo, or other games of chance. Some of these other types of embodiments will be discussed below as variations to the examples illustrated. However, many other types of games can implement similar techniques and fall within the scope of this disclosed concept.

Referring to the example gaming apparatus 100 shown in FIG. 1, the representative gaming apparatus includes at least a display area(s) 102 (also referred to as a gaming display), and a player interface area(s) 104, although some or all of the interactive mechanisms included in the user interface area 104 may be provided via other or additional means, such as graphical icons used with a touch screen in the display area 102 in some embodiments. The display area 102 may include one or more game displays 106 (also referred to as "displays" or "gaming displays") that may be included in physically separate displays or as portions of a common large display. Here, the representative game display 106 includes at least a primary game play portion 108 that displays game elements and symbols 110, and an operations portion 109 that can include meters, various game buttons and other input mechanisms, and/or other game information for a player of the gaming device 100.

The user interface 104 allows the user to control, engage in play of, and otherwise interact with the gaming machine 100. The particular user interface mechanisms included with user interface 104 may be dependent on the type of gaming device. For example, the user interface 104 may include one or more buttons, switches, joysticks, levers, pull-down handles, trackballs, voice-activated input, touchscreen input, tactile input, and/or any other user input system or mechanism that allows the user to play and interact with the particular gaming activity.

The user interface 104 may allow the user or player to enter coins, bills, or otherwise obtain credits through vouchers, tokens, credit cards, tickets, electronic money, etc. Various mechanisms for entering such vouchers, tokens, credit cards, coins, tickets, etc. are described below with reference to FIG. 2. For example, currency input mechanisms, card readers, credit card readers, smart card readers, punch card readers, radio frequency identifier (RFID) readers, and other mechanisms may be used to enter wagers. The user interface 104 may also include a mechanism to read and/or validate player information, such as player loyalty information to identify a user or player of the gaming device. This mechanism may be, for example, a card reader, biometric scanner, keypad, or other input device. It is through a user interface such as the user interface 104 that the player can initiate and engage in gaming activities. While the illustrated embodiment depicts various buttons for the user interface 104, it should be recognized that a wide variety of user interface options are available for use in connection with the present invention, including pressing buttons, touching a segment of a touch-screen, entering text, entering voice commands, or other known data entry methodology.

The game display 106 in the display area 102 may include one or more of an electronic display, a video display, a mechanical display, and fixed display information, such as pay table information associated with a glass/plastic panel(s) on the gaming machine 100 and/or graphical images. The symbols or other indicia associated with the play of the game may be presented on an electronic display device or on mechanical devices associated with a mechanical display. Generally, in some embodiments, the display 106 devotes the largest portion of viewable area to the primary gaming portion 108. The primary gaming portion 108 may provide visual feedback to the user for any selected game. The primary gaming portion 108 may render graphical objects such as cards, slot reels, dice, animated characters, and any other gaming visual known in the art. The primary gaming portion 108 may also inform players of the outcome of any particular event, including whether the event resulted in a win or loss.

In some example embodiments illustrated herein, the primary gaming portion 108 may display a grid (or equivalent arrangement) of game elements 110 or game element positions (also referred to herein as "reel stop positions"). As illustrated in the embodiment shown in FIG. 1, the grid includes three rows and five columns of game elements 110, which may form a game outcome(s) of a game play event from which prizes are determined. In some slot machine examples, each column may display a portion of a game reel. The game reels may include a combination of game symbols in a predefined order. In mechanical examples, the game reels may include physical reel strips where game symbols are shown in images fixed on the reel strips. Virtual reel strips may be mapped to these physical reel positions shown on the reel strips to expand the range or diversity of game outcomes. In video slot examples, reel strips may be encoded in a memory or database and virtual reels may be used for the game reels with images representing the data related to the reel strips. In other slot machine embodiments, each reel stop position on the grid may be associated with an independent reel strip. In yet other slot machine embodiments, reels and/or reel strips may not be used at all in determining the symbols shown in the game element positions of the grid. For example, a symbol may be randomly selected for each game element position, or the symbols may be determined in part by game events occurring during game play, such as displayed elements being replaced by new game elements or symbols. Numerous variations are possible for implementing slot-type game play.

The primary gaming portion 108 may include other features known in the art that facilitate gaming, such as status and control portion 109. As is generally known in the art, this portion 109 provides information about current bets, current wins, remaining credits, etc. associated with gaming activities of the grid of game elements 110. The control portion 109 may also provide touchscreen controls for facilitating game play. The grid of game elements 110 may also include touchscreen features, such as facilitating selection of individual symbols, or user controls over stopping or spinning reels. The game display 106 of the display area 102 may include other features that are not shown, such as pay tables, navigation controls, etc.

Figure 2:
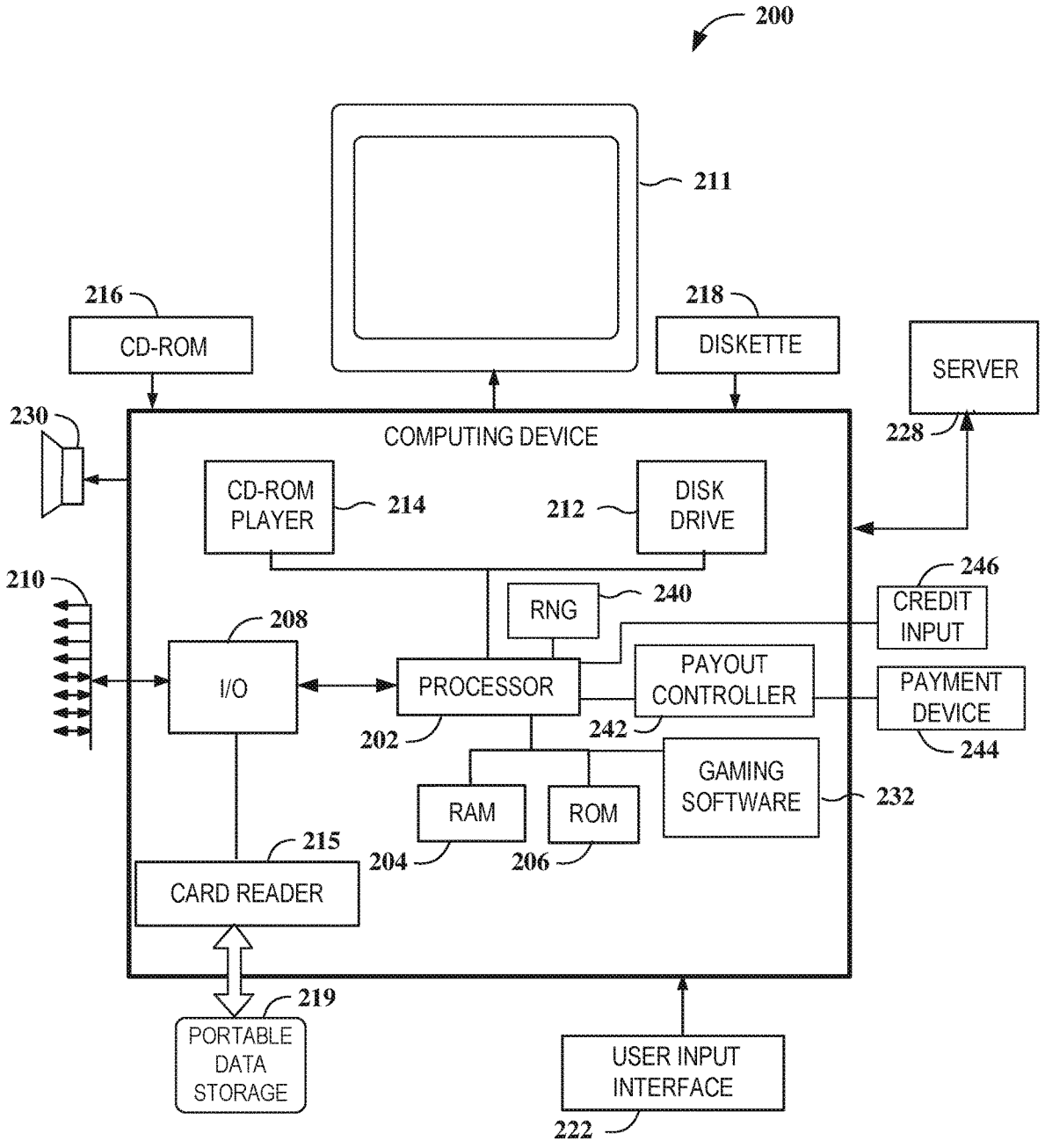
FIG. 2 is a block diagram illustrating a representative computing arrangement capable of implementing games and features in accordance with the disclosure and representative embodiments described herein.

Although FIG. 1 illustrates a particular implementation of some of the embodiments of this invention in a casino or electronic gaming machine ("EGM"), one or more devices may be programmed to play various embodiments of the invention. The concepts and embodiments described herein may be implemented, as shown in FIG. 1, as a casino gaming machine or other special purpose gaming kiosk as described herein, or may be implemented via computing systems operating under the direction of local gaming software, and/or remotely-provided software such as provided by an application service provider (ASP). Casino gaming machines may also utilize computing systems to control and manage the gaming activity, although these computing systems typically include specialized components and/or functionality to operate the particular elements of casino gaming machines. Additionally, computing systems operating over networks, such as the Internet, may also include specialized components and/or functionality to operate elements particular to these systems, such as random number generators. An example of a representative computing system capable of carrying out operations in accordance with the principles described herein is illustrated in FIG. 2.

Hardware, firmware, software or any combination thereof may be used to perform the various gaming functions, display presentations and operations described herein. The functional modules used in connection with the disclosure may reside in a gaming machine as described, or may alternatively reside on a stand-alone or networked computer. The representative computing structure 200 of FIG. 2 is an example of a computing structure that can be used in connection with such electronic gaming machines, computers, or other computer-implemented devices to carry out operations of the present invention. Although numerous components or elements are shown as part of this computing structure 200 in FIG. 2, additional or fewer components may be utilized in particular implementations of embodiments of the invention.

The example computing arrangement 200 suitable for performing the gaming functions described herein includes a processor, such as depicted by the representative central processing unit (CPU) 202, coupled to memory, such as random access memory (RAM) 204, and some variation of read-only memory (ROM) 206 or other persistent storage. The ROM 206 may also represent other types of storage media to store programs, such as programmable ROM (PROM), erasable PROM (EPROM or any technology capable of storing data). The processor 202 may communicate with other internal and external components through input/output (I/O) circuitry 208 and bussing 210, to communicate control signals, communication signals, and the like.

The computing arrangement 200 may also include one or more data storage devices, including hard and floppy disk drives 212, CD-ROM drives 214, card reader 215, and other hardware capable of reading and/or storing information such as DVD, etc. In one embodiment, software for carrying out the operations in accordance with the present invention may be stored and distributed on a CD-ROM 216, diskette 218, access card 219, or other form of computer readable media capable of portably storing information. These storage media may be inserted into, and read by, devices such as the CD-ROM drive 214, the disk drive 212, card reader 215, etc. The software may also be transmitted to the computing arrangement 200 via data signals, such as being downloaded electronically via a network, such as local area network (casino, property, or bank network) or a wide area network (e.g., the Internet). Further, as previously described, the software for carrying out the functions associated with the present invention may alternatively be stored in internal memory/storage of the computing device 200, such as in the ROM 206.

The computing arrangement 200 is coupled to one or more displays 211, which represent a manner in which the gaming activities may be presented. The display 211 represents the "presentation" of the game information in accordance with the disclosure, and may be a mechanical display showing physical spinning reels, a video display, such as liquid crystal displays, plasma displays, cathode ray tubes (CRT), digital light processing (DLP) displays, liquid crystal on silicon (LCOS) displays, etc., or any type of known display or presentation screen.

Where the computing device 200 represents a stand-alone or networked computer, the display 211 may represent a standard computer terminal or display capable of displaying multiple windows, frames, etc. Where the computing device 200 represents a mobile electronic device, the display 211 may represent the video display of the mobile electronic device. Where the computing device 200 is embedded within an electronic gaming machine, the display 211 corresponds to the display screen of the gaming machine/kiosk.

A user input interface 222 such as a mouse, keyboard/keypad, microphone, touch pad, trackball, joystick, touch screen, voice-recognition system, card reader, biometric scanner, RFID detector, etc. may be provided. The user input interface 222 may be used to input commands in the computing arrangement 200, such as placing wagers or initiating gaming events on the computing arrangement 200, inputting currency or other payment information to establish a credit amount or wager amount, inputting data to identify a player for a player loyalty system, etc. The display 211 may also act as a user input device, e.g., where the display 211 is a touchscreen device. In embodiments, where the computing device 200 is implemented in a personal computer, tablet, smart phone, or other consumer electronic device, the user interface and display may be the available input/output mechanisms related to those devices.

Chance-based gaming systems such as slot machines, in which the present invention is applicable, are governed by random numbers and processors, as facilitated by a random number generator (RNG) or other random generator. The fixed and dynamic symbols generated as part of a gaming activity may be produced using one or more RNGs. RNGs may be implemented using hardware, software operable in connection with the processor 202, or some combination of hardware and software. The principles described herein are operable using any known RNG, and may be integrally programmed as part of the processor 202 operation, or alternatively may be a separate RNG controller 240 that may be associated with the computing arrangement 200 or otherwise accessible such as via a network. The RNGs are often protected by one or more security measures to prevent tampering, such as by using secured circuitry, locks on the physical game cabinet, and/or remote circuitry that transmits data to the gaming device.

The computing arrangement 200 may be connected to other computing devices or gaming machines, such as via a network. The computing arrangement 200 may be connected to a network server(s) 228 in an intranet or local network configuration. The computer may further be part of a larger network configuration as in a global area network (GAN) such as the Internet. In such a case, the computer may have access to one or more web servers via the Internet. In other arrangements, the computing arrangement 200 may be configured as an Internet server and software for carrying out the operations in accordance with the present invention may interact with the player via one or more networks. The computing arrangement 200 may also be operable over a social network or other network environment that may or may not regulate the wagering and/or gaming activity associated with gaming events played on the computing arrangement.

Other components directed to gaming machine implementations include manners of gaming participant payment, and gaming machine payout. For example, a gaming machine including the computing arrangement 200 may also include a payout controller 242 to receive a signal from the processor 202 or other processor(s) indicating a payout is to made to a player and controlling a payout device 244 to facilitate payment of the payout to the player. In some embodiments, the payout controller 242 may independently determine the amount of payout to be provided to the participant or player. In other embodiments, the payout controller 242 may be integrally implemented with the processor 202. The payout controller 242 may be a hopper controller, a print driver, credit-transmitting device, bill-dispensing controller, accounting software, or other controller device configured to verify and/or facilitate payment to a player.

A payout or payment device 244 may also be provided in gaming machine embodiments, where the payment device 244 serves as the mechanism providing the payout to the player or participant. In some embodiments, the payment device 244 may be a hopper, where the hopper serves as the mechanism holding the coins/tokens of the machine, and/or distributing the coins/tokens to the player in response to a signal from the payout controller 242. In other embodiments, the payout device 244 may be a printer mechanism structured to print credit-based tickets that may be redeemed by the player for cash, credit, or other casino value-based currency or asset. In yet other embodiments, the payout device 244 may send a signal via the network server 228 or other device to electronically provide a credit amount to an account associated with the player, such as a credit card account or player loyalty account. The computing arrangement 200 may also include accounting data stored in one of the memory devices 204, 206. This accounting data may be transmitted to a casino accounting network or other network to manage accounting statistics for the computing arrangement or to provide verification data for the currency or currency-based tickets distributed by the payout device, such as providing the data associated with the bar codes printed on the currency-based tickets so they are identifiable as valid tickets for a particular amount when the player redeems them or inserts them in another gaming device.

The wager input module or device 246 represents any mechanism for accepting coins, tokens, coupons, bills, electronic fund transfer (EFT), tickets, credit cards, smart cards, membership/loyalty cards, or any other player assets, for which a participant inputs a wager amount. The wager input device 246 may include magnetic strip readers, bar code scanners, light sensors, or other detection devices to identify and validate physical currency, currency-based tickets, cards with magnetized-strips, or other medium inputted into the wager input device. When a particular medium is received in the wager input device 246, a signal may be generated to establish or increase an available credit amount or balance stored in the internal memory/storage of the computing device 200, such as in the RAM 204. Thereafter, specific wagers placed on games may reduce the available credit amount, while awards won may increase the available credit amount. It will be appreciated that the primary gaming software 232 may be able to control payouts via the payment device 244 and payout controller 242 for independently determined payout events.

Among other functions, the computing arrangement 200 provides an interactive experience to players via an input interface 222 and output devices, such as the display 211, speaker 230, etc. These experiences are generally controlled by gaming software 232 that controls a primary gaming activity of the computing arrangement 200. The gaming software 232 may be temporarily loaded into RAM 204, and may be stored locally using any combination of ROM 206, drives 212, media player 214, or other computer-readable storage media known in the art. The primary gaming software 232 may also be accessed remotely, such as via the server 228 or the Internet.

The primary gaming software 232 in the computing arrangement 200 may be an application software module. According to embodiments of the present invention, this software 232 provides a slot game or similar game of chance as described herein. For example, the software 232 may present, by way of the display 211, representations of symbols to map or otherwise display as part of a slot based game having reels. However, in other embodiments, the principles of this concept may be applied to poker games or other types of games of chance. One or more aligned positions of these game elements may be evaluated to determine awards based on a pay table. The software 232 may include instructions to provide other functionality as known in the art or as described and shown herein.

The systems, apparatuses and methods operable via these and analogous computing and gaming devices can support gaming features as described herein. One embodiment involves providing a progressive jackpot(s) with must-hit functionality and non-resetting progressive jackpots. Many embodiments may be described in terms of a slot game, where symbols are matched on paylines to determine payout awards. However, the principles described herein are equally applicable to other games of chance, as described herein and as will be readily apparent to those skilled in the art from the teachings herein.

Embodiments of the present concept include providing gaming devices (also referred to as gaming apparatuses or gaming machines), gaming systems, and methods of operating these devices or systems to provide game play that utilizes operations of enhancing game awards in gaming devices. In one embodiment, a method of operating a gaming device includes providing one or more progressive awards that can be awarded based on triggering conditions during game play of the gaming device. In addition, the one or more progressive award is associated with a hit condition, such as a must-hit-by condition, and is not reset when hit based on the triggering conditions during game play of the gaming device. Thus, in one embodiment, the one or more progressives are only reset when the must-hit-by condition is reached. This provides players the opportunity to hit a progressive multiple times without its value resetting, and with the possibility that it will hit again due to the must-hit-by condition.

In some embodiments, the must-hit-by condition may be associated with a progressive meter value, with a number of games played, with an amount of coin-in, with a time period, or with any other identifiable condition that is certain to happen in the future. In some embodiments, the must-hit-by condition is selected at random, which in other embodiments, it may be fixed and set by a casino operator, game designer, or other person with access privileges to set the must-hit-by condition. In one example embodiment, a three-level progressive may have reset values of $50, $250, and $1000, for the P3, P2, and P1 progressives, respectively. Must-hit-by conditions are set for each progressive meter. Here, the P3 must-hit-by value is a random number of game played in the range of 20 games to 1000 games, the P2 must-hit-by value is a random selection of the value of the second progressive in the range of $275-$1000, and the P3 must-hit-by value is an operator selectable date and time. In the above example, a player may play the gaming device and hit the P3 progressive based on a gaming outcome, where the P3 progressive meter is at $70. However, the P3 meter does not reset back to $50. Rather it is maintained at $70 and the number of games working toward the must-hit-by condition continues. Here, the player may get the P3 progressive in the next few games because it reaches the must-hit-by condition. Hence, the player may have an incentive to continue playing the game in hopes that they are close to the must-hit-by condition threshold. In some embodiments, the must-hit-by condition may be partially or fully communicated to the player so they know how close the progressives are to hitting (or at least some rough idea of how close they are to hitting). In other embodiments, the must-hit-by conditions are unknown to players.

Figure 3:
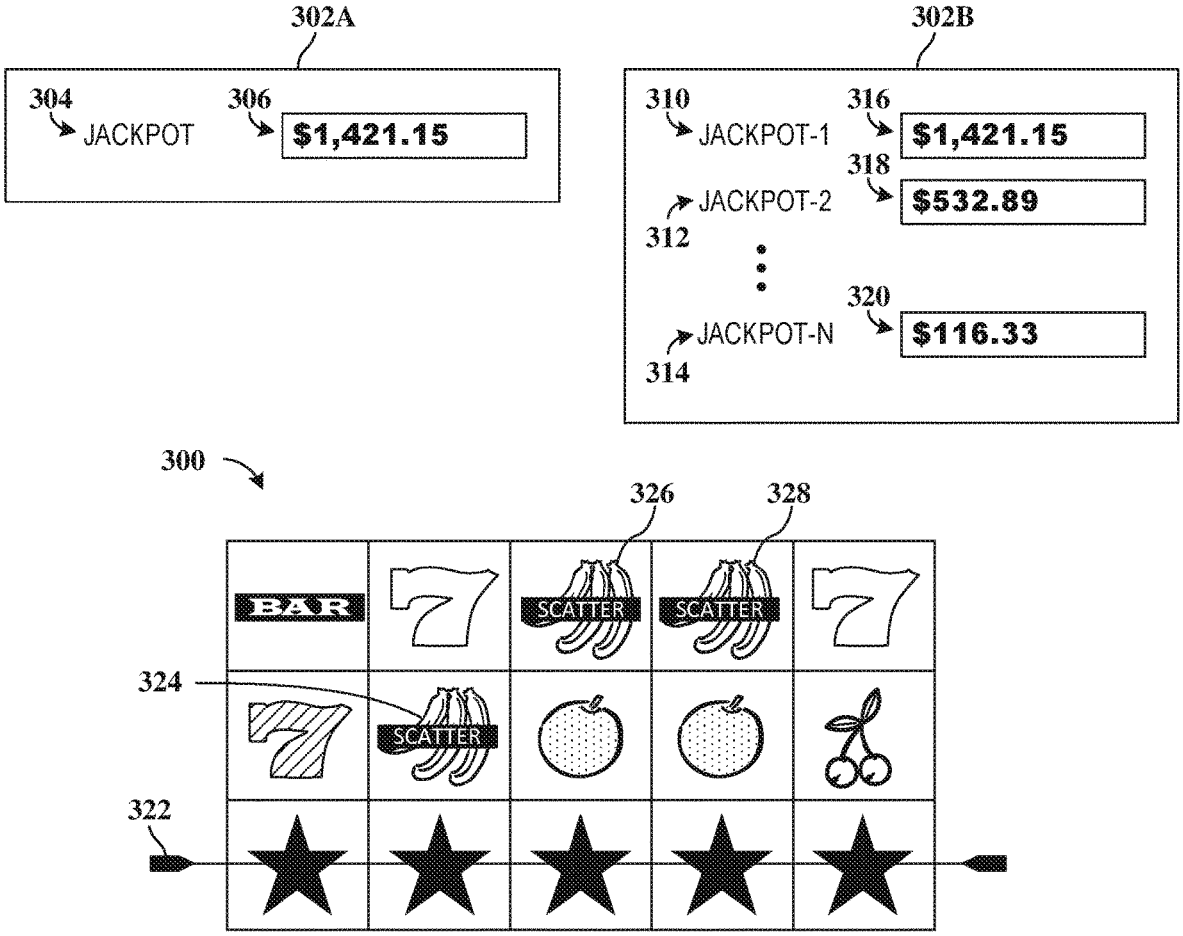
FIG. 3 depicts a representative slot game that may implement one or more progressive jackpots.

FIG. 3 is described in the context of a slot game embodiment, although the principles described herein are equally applicable to other games of chance. This embodiment depicts a slot game having a grid 300 of symbol locations in which gaming symbols are presented as part of the gaming activity. Symbols in the grid 300 may be individually placed in the various symbol locations, or may be placed in the symbol locations by physical or virtual spinning reels a column or row at a time, or any other desired manner of populating the grid 300. While the principles described herein are equally applicable to other wagering games, such as poker, or any other game where a progressive jackpot(s) may be utilized, embodiments herein may be described in terms of slot games where progressive jackpots abound.

FIG. 3 depicts a display 302A where a progressive jackpot 304 is depicted, which is associated with a current progressive jackpot value 306. Other gaming devices may include multiple jackpots. Display 302B depicts multiple jackpots, including jackpot-1 310, jackpot-2 312, or as many more as desired up to a final jackpot-N 314, each with respective jackpot amounts 316, 318, 320.

Jackpot 304 and its associated current value 306 are now used as an example. Generally, when some event(s) occurs via grid 300 during participation in the slot game event, a progressive jackpot 304 may be awarded. Exemplary events that may be configured to award a progressive jackpot 304 include certain symbol combinations, such as the symbol combination of five consecutive star symbols on payline 322, a scatter pay where a predetermined number of symbols (e.g., scatter symbols 324, 326, 328) randomly appear anywhere or in predetermined positions, reels, etc. on the grid 300, randomly appearing indications, sub-symbols, overlays, etc. Any desired manner of awarding a progressive jackpot may be implemented.

In accordance with the principles described herein, a progressive jackpot 304 may include conditions that dictate when the jackpot is to be awarded. For example, the progressive jackpot 304 may have a range, and/or an upper limit, whereby the jackpot is configured to be awarded within that range or at least by the time it reaches the upper limit. Additionally, embodiments described herein further enable progressive jackpots 304 to continue to climb in value even when awarded, if the progressive jackpot 304 has not been subject to a value reset condition that is dependent on the guaranteed award condition or level. Various embodiments are described herein. While various embodiments are described in terms of a single progressive jackpot 304, the principles described herein are equally applicable to embodiments involving multiple jackpots 310, 312, 314.

Figure 4:
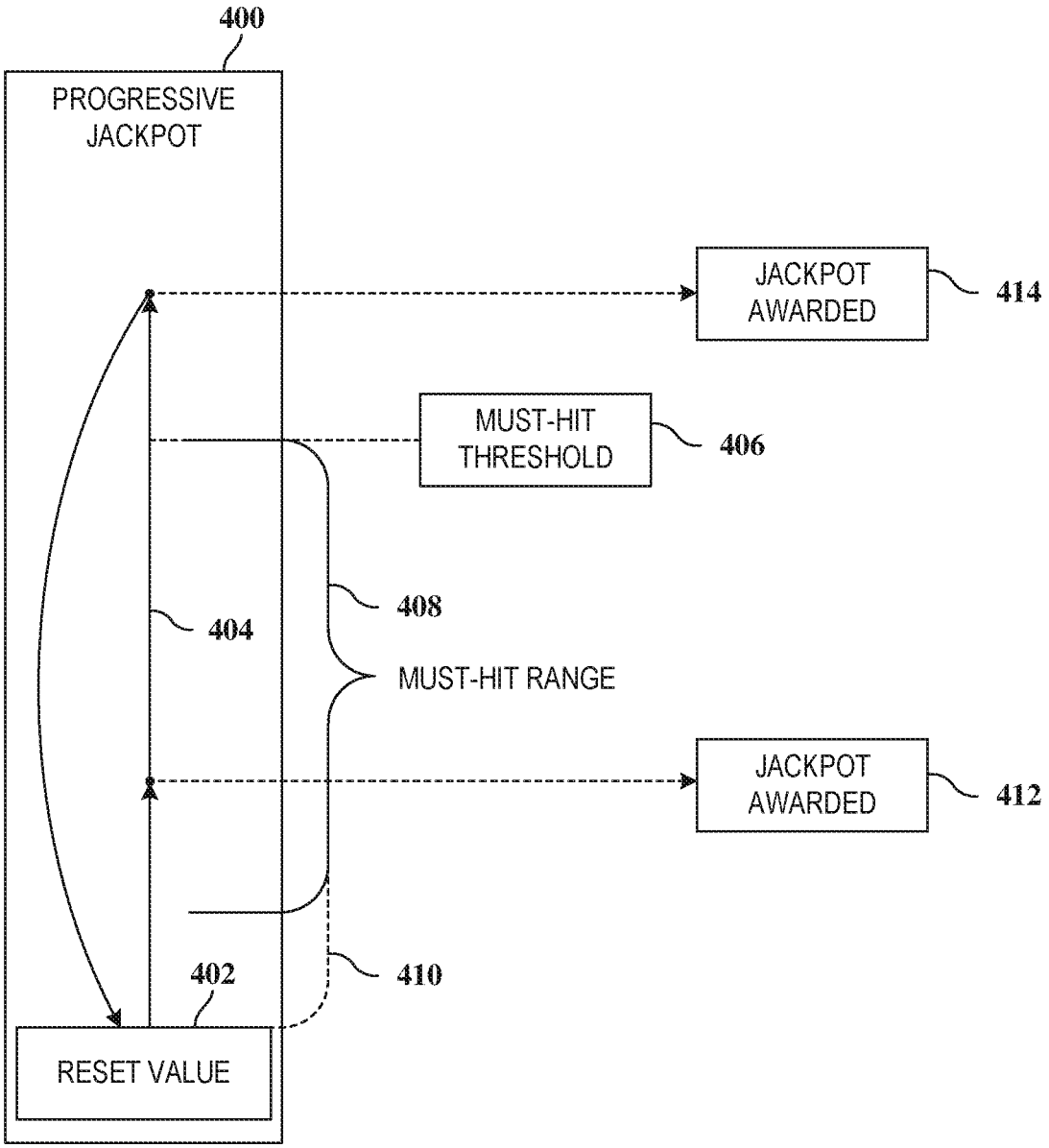
FIG. 4 is a block diagram depicting a representative manner in which a progressive jackpot includes a guaranteed hit range and threshold, and where the progressive jackpot does not reset for some jackpot awards occurring before reaching the guaranteed hit threshold.

FIG. 4 is a block diagram depicting one embodiment of a manner in which a progressive jackpot 400 includes a required or guaranteed "must-hit" range and threshold, and a non-resetting jackpot value for some jackpot awards occurring before reaching the must-hit threshold. The progressive jackpot 400 may start with any desired reset value 402, which may be a zero or non-zero reset value 402. Vertical line 404 starting at the reset value 402 represents an increase of the progressive jackpot value as players pay to participate in the slot game events. The "payment" by the player may be real money or other player assets when in wagering situations, or simulated money, credits, or other items having the appearance of assets in non-wagering situations. As players pay to participate in the slot game events, a portion of those payments is allocated to the progressive jackpot 400, causing it to rise in value which is depicted by line 404.

In this embodiment, a monetary threshold is established, such as the must-hit threshold 406. In one embodiment, the must-hit threshold 406 represents the upper limit of a must-hit range 408 in which the progressive jackpot 400, at whatever its current value is at that time, is guaranteed to be awarded. For example, the must-hit range 408 may represent some subset of the possible value of the progressive jackpot 400, and once within that range 408, the system is configured to ensure that the progressive jackpot 400 will be awarded. The must-hit threshold 406 represents a selected upper limit for that must-hit range 408. In one embodiment, the subset of the possible value of the progressive jackpot 400 within the range 408 may extend all the way to the reset value 402, as depicted by extended range line 410.

In one embodiment, where the progressive jackpot 400 is awarded 412 at a position within the must-hit range 408, the player will receive the current value of the progressive jackpot 400, but the progressive jackpot 400 will not return to its reset value 400. In one embodiment, the progressive jackpot 400 does not decrease at all, and instead continues to rise as if no jackpot had been awarded 412 at all. Therefore, a jackpot was indeed awarded 412 as a result of the must-hit requirement within the must-hit range 408, but the jackpot is not reset. In one embodiment, a jackpot awarded 414 after surpassing the must-hit threshold 406 will cause the progressive jackpot 400 to be reset to some reset value 402.

Thus, embodiments such as that described in connection with FIG. 4, may involve establishing a monetary threshold, such as must-hit threshold 406, where a progressive jackpot 400 is guaranteed to be awarded 412 at or below the monetary threshold, and causing the progressive jackpot 400 to be awarded 412 at a monetary value at or below the monetary threshold 406. When the progressive jackpot 400 has been awarded 412 below the monetary threshold 406, the progressive jackpot 400 may be maintained at its current monetary level and the progressive jackpot 400 is allowed to continue to increase in value. In one embodiment, the progressive jackpot is reset to its reset value 402 in response to the progressive jackpot 400 being awarded 414 when the value of the progressive jackpot 400 has exceeded the monetary threshold 406 where the progressive jackpot 400 is guaranteed to be awarded.

Figure 5:
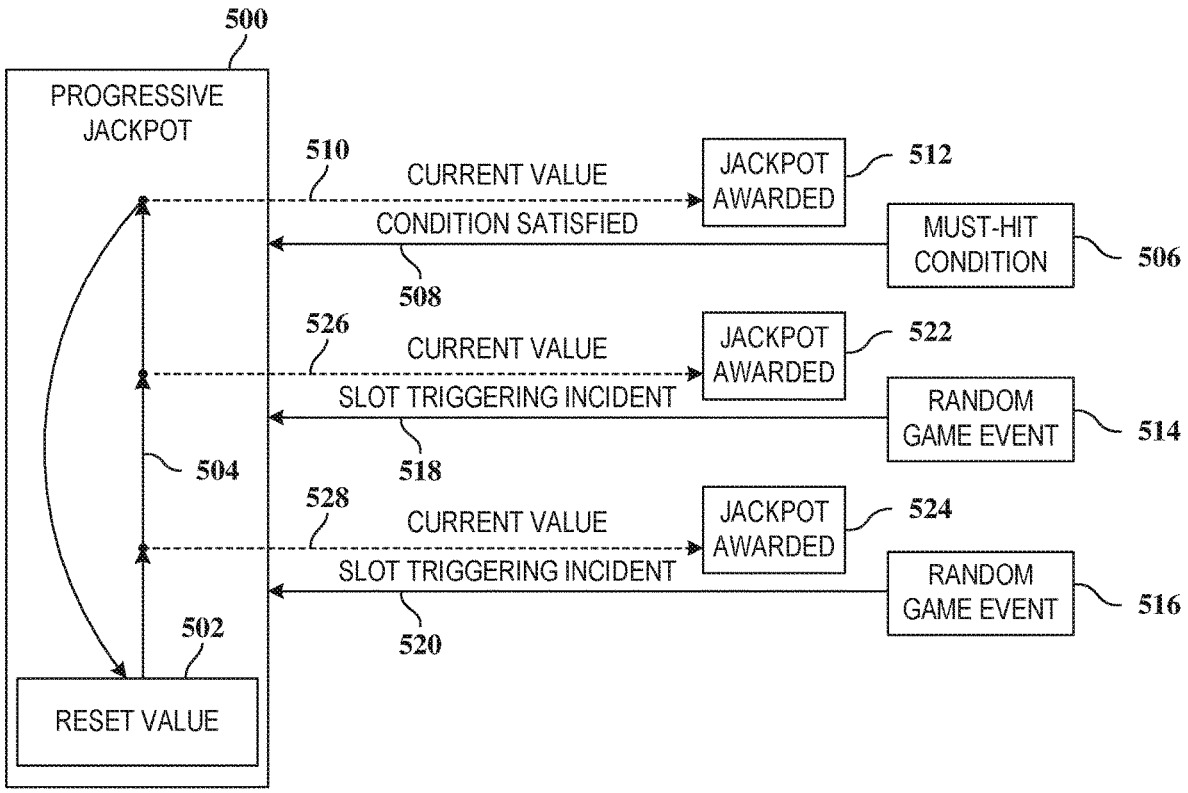
FIG. 5 is a block diagram depicting a representative manner in which a progressive jackpot includes a guaranteed hit condition for awarding the progressive jackpot with reset, while allowing other progressive jackpots to be awarded without reset.

FIG. 5 is a block diagram depicting one embodiment of a manner in which a progressive jackpot 500 includes a required or guaranteed "must-hit" condition for awarding the progressive jackpot 500 with reset, while allowing other progressive jackpots to be awarded without reset. The progressive jackpot 500 may start with any desired reset value 502, which may be a zero or non-zero reset value 502. Vertical line 504 starting at the reset value 502 represents an increase of the progressive jackpot value as players pay to participate in the slot game events. As players pay to participate in the slot game events, a portion of those payments is allocated to the progressive jackpot 500, causing it to rise in value which is depicted by line 504.

In this embodiment, a must-hit condition(s) 506 is provided, where the progressive jackpot 500 will be awarded upon satisfaction of that must-hit condition 506. When the condition 506 is satisfied 508, the current value 510 of the progressive jackpot 500 will be awarded 512. The player may be presented with a predetermined symbol combination or other event on the gaming grid of the slot game event to award the jackpot, but in one embodiment the satisfaction 508 of the must-hit condition 506 causes that predetermined symbol combination or other event on the slot game to occur. When this jackpot is awarded 512 as a result of the must-hit condition 506 being satisfied 508, the progressive jackpot 500 is reset to its reset value 502 in one embodiment.

In the embodiment of FIG. 5, the progressive jackpot 500 may be awarded for reasons other than the must-hit condition 506 being satisfied 508. For example, slot triggering incidents, such as the occurrence of symbol combinations or other events during the slot game events (e.g., reel spins), may occur naturally as the slot game progresses. For such naturally occurring symbol combinations or other random game events 514, 516 that cause such slot triggering incidents 518, 520, the progressive jackpot 500 is awarded 522, 524 at its current value 526, 528 at the time it is awarded.

In one embodiment, when such progressive jackpots 500 are awarded 522, 524 in response to a random game event 514, 516, rather than as a result of satisfying 508 a must-hit condition 506, the progressive jackpot 500 does not reset. This is depicted on line 504, which continues to increase in value even though the progressive jackpot 500 was awarded 522, 524 (and in this example, awarded multiple times).

Therefore, embodiments such as that described in connection with FIG. 5 may involve providing a progressive jackpot(s) 500 whose value increases as the slot game events progress, establishing a condition(s) 506 where the progressive jackpot 500 is guaranteed to be awarded, and causing the progressive jackpot 500 to be awarded 512 when that condition 506 is satisfied 508. Additionally, in such embodiments, the progressive jackpot 500 is allowed to be awarded in response to triggering incidents 518, 520 during play of the slot game events, where the progressive jackpot 500 maintains its current value 526, 528 and is allowed to continue to increase in value, rather than resetting to some lower level. In another embodiment, the progressive jackpot 500 is reset to the reset value 502 in response to the progressive jackpot 500 being awarded upon satisfaction 508 of the must-hit condition 506.

Figure 6A:
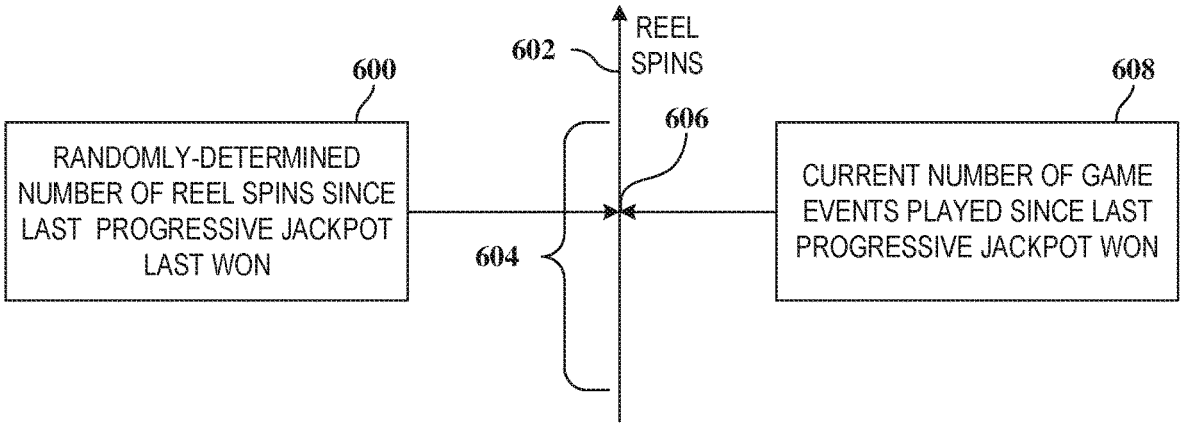
FIGS. 6A, 6B and 6C depict representative examples of guaranteed hit conditions that may be used in connection with the disclosure.
Figure 6B:
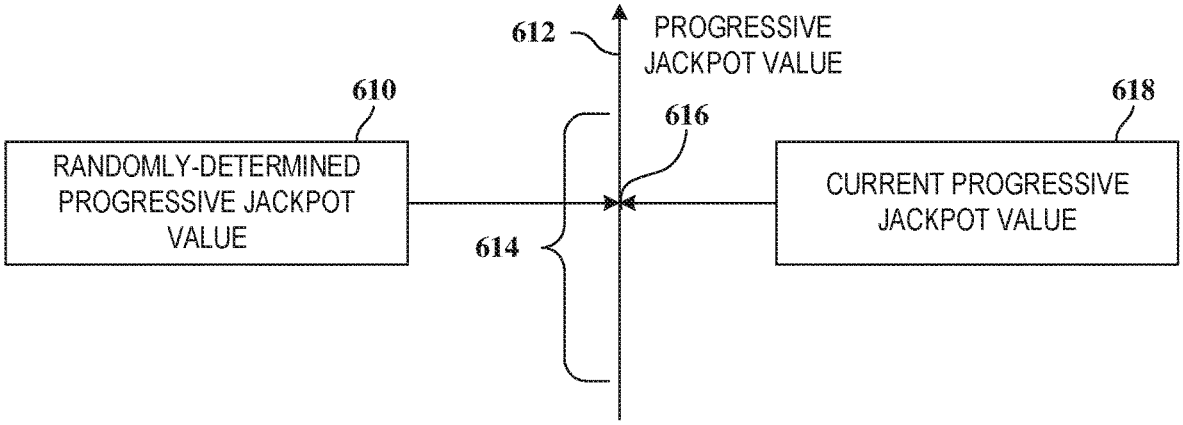
Figure 6C:
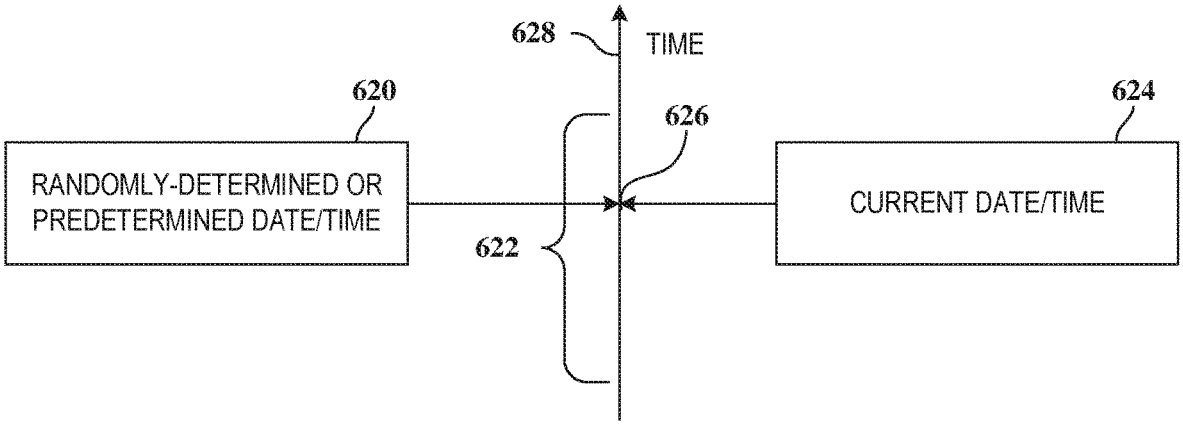

FIGS. 6A, 6B and 6C depict representative examples of must-hit conditions, such as the must-hit condition 506 of FIG. 5. A must-hit condition may be established as a randomly-determined number 600 of played reel spins 602 (or other gaming events), since the last time the progressive jackpot was won. In the embodiment of FIG. 6A, the must-hit condition has a range 604 in which the must-hit condition is allowed to occur. For example, in one representative embodiment, the range 604 may be from 100 reel spins 602 to 400 reel spins 602, whereby the randomly-determined number 600 of reel spins to win the award will be established to randomly occur within that range 604. That randomly-determined number 600 is randomly selected in one embodiment, and in the illustrated embodiment occurs at a number of reel spins 602 corresponding to point 606 on the continuum of reel spins 602. When the current number 608 of reel spin events since the last progressive jackpot was won reaches the point 606 corresponding to the randomly-determined number 600, the condition has been satisfied (e.g., such as the condition satisfied 508 of FIG. 5).

In another embodiment depicted in FIG. 6B, the must-hit condition may be established as a randomly-determined progressive jackpot value 610 of the increasing progressive jackpot value 612. In this embodiment, the must-hit condition may have a range 614 in which the must-hit condition is allowed to occur. For example, in one representative embodiment, the range 614 may be from a $300 progressive jackpot value 612 to a $600 progressive jackpot value 612, whereby the randomly-determined progressive jackpot value 610 to win the award will be established to randomly occur within that range 614. That randomly-determined value 610 is randomly selected in one embodiment, and in the illustrated embodiment occurs at a progressive jackpot 612 corresponding to point 616 on the continuum of progressive jackpot value 612. When the current progressive jackpot value 618 reaches the point 616 corresponding to the randomly-determined progressive jackpot value 610, the condition has been satisfied.

In another embodiment depicted in FIG. 6C, the must-hit condition may be established as a randomly-determined or predetermined date/time 620. For example, a date range 622 may be established as a condition, and the particular date/time randomly selected from the range 622 may operate as the randomly-determined date and time. In other embodiments, the date and time may be predetermined, such as selected by a casino operator, and established as a set date and time. When the current date/time 624 reaches the randomly-determined or predetermined date/time at point 626 along the continuum of time 628, the condition has been satisfied.

The features described herein can be used in connection with any game of chance, including slot games, poker games, keno, roulette, bingo, and the like. They may be provided using physical structures, or electronic structures created in computing hardware and displayed as virtual structures of such physical structures. The gaming events described herein may be provided as a base game of chance or an auxiliary gaming event such as a bonus event, free spin event, or other secondary event.

Figure 7A:
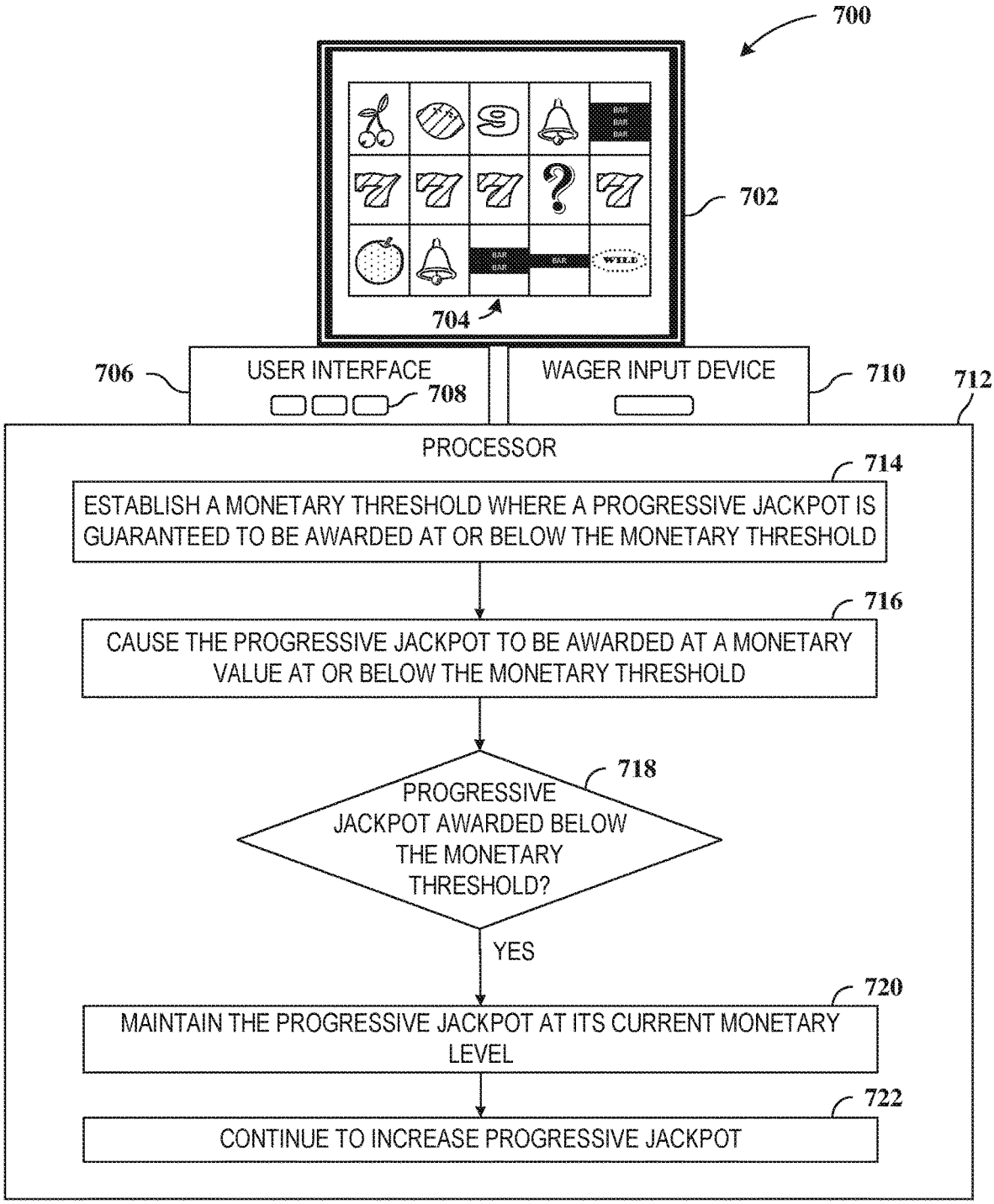
FIGS. 7A and 7B are block diagrams of a representative slot game apparatus for providing a progressive jackpot with must-hit functionality and non-resetting progressive jackpots.

FIG. 7A is a block diagram of a representative slot game apparatus for providing a progressive jackpot with must-hit functionality and non-resetting progressive jackpots. In this embodiment, a slot game device 700 is provided on which players can play slot games. The representative slot game device 700 includes at least a display 702 presenting a slot game symbol array or "grid" 704 of symbol locations, a user interface 706 including at least one user input 708 to enable a player to initiate a slot game event presented via the slot game grid 704, and a wager input device 710 structured to identify and validate player assets and ultimately permit the player to play the slot game event when the player assets are provided. The slot game device 700 also includes a processor 712 configured to establish 714 a monetary threshold where a progressive jackpot is guaranteed to be awarded at or below the monetary threshold, and cause 716 the progressive jackpot to be awarded at a monetary value at or below the monetary threshold. When it is determined 718 when the progressive jackpot has been awarded below the monetary threshold, the progressive jackpot is maintained 720 at its current monetary level, and is allowed to continue 722 to increase in value. In one embodiment, if it is determined 718 that the progressive jackpot was not awarded below the monetary threshold, then the value of the progressive jackpot was awarded above the monetary threshold, and the progressive jackpot is reset in response thereto.

The slot game device 700 configures the processor 712 (which may include one or more cooperative processing devices) to structurally program functional elements into hardware modules. Processor 712 circuitry configuration thus changes based on the modules developed by software to carry out the desired methodology. For example, the processor 712 is programmed by software/code to create a hardware-based module to establish 714 the monetary threshold, and to create other such software/code modules for each of the operations 714-722.

Figure 7B:
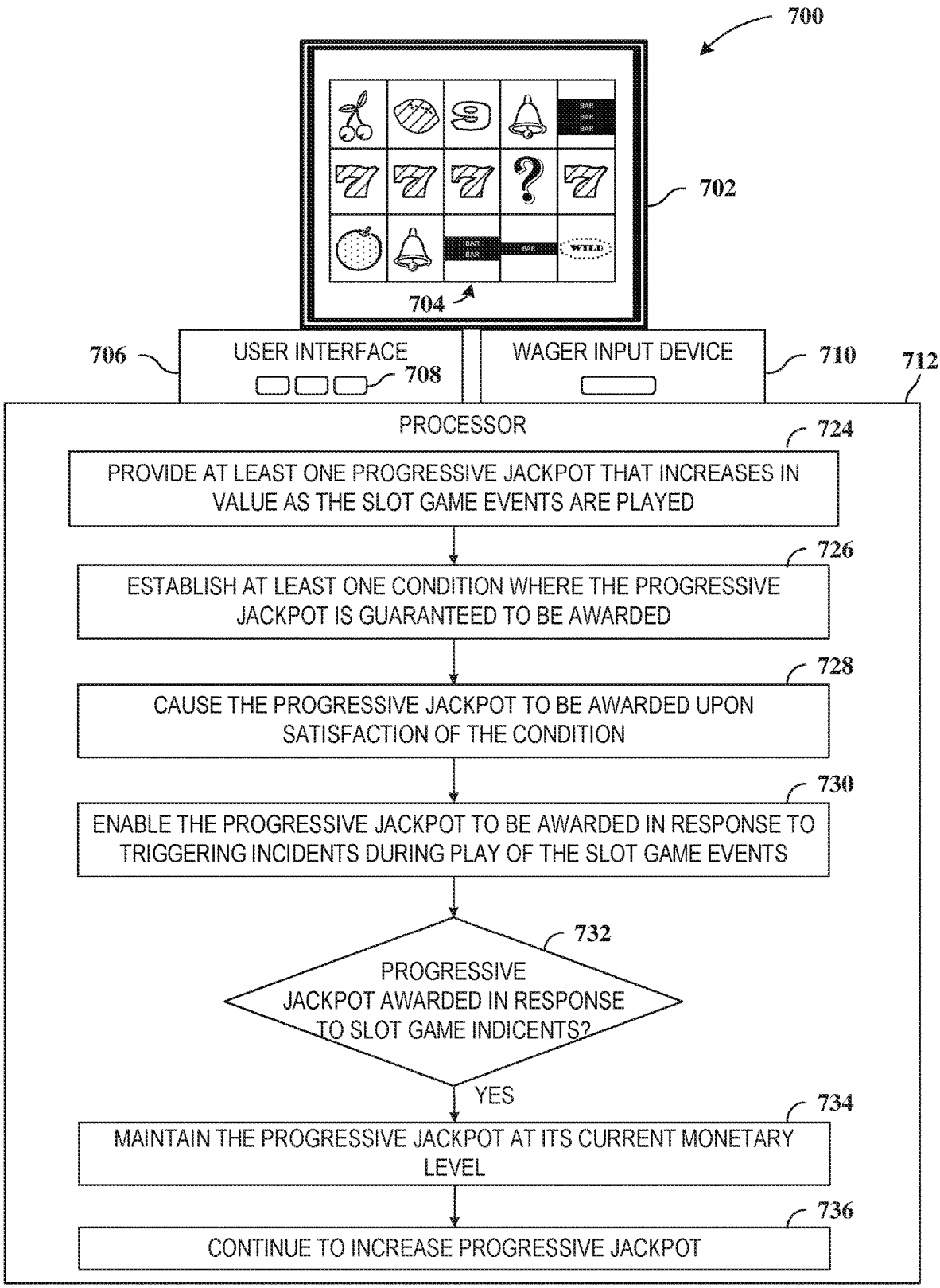

Other structural modules may be created on the slot game device using a properly configured processor 712. Referring now to the example of FIG. 7B, the processor 712 may be configured into programmed modules to provide 724 a progressive jackpot(s) that increases in value as the slot game events are played, establish 726 a condition(s) where the progressive jackpot is guaranteed to be awarded, cause 728 the progressive jackpot to be awarded upon satisfaction of the condition, and enable 730 the progressive jackpot to be awarded in response to triggering incidents during play of the slot game events. When it is determined 732 that the progressive jackpot has been awarded in response to the triggering incidents during the slot game play, the processor 712 modules may further maintain 734 the progressive jackpot at its current value, and continue 736 to increase the progressive jackpot's value. In one embodiment, where the progressive jackpot was not awarded in response to slot game incidents, then it was awarded upon satisfaction of the guaranteed jackpot condition, and the progressive jackpot is reset to a lower reset value.

The foregoing description of the representative embodiments has been presented for the purposes of illustration and description. It is not intended to be exhaustive or to limit the invention to the precise form disclosed. Many modifications and variations are possible in light of the above teaching. For example, the present invention is equally applicable in electronic or mechanical gaming machines, and is also applicable to live table versions of gaming activities that are capable of being played in a table version (e.g., machines involving poker or card games that could be played via table games).

Some embodiments have been described above, and in addition, some specific details are shown for purposes of illustrating the inventive principles. However, numerous other arrangements may be devised in accordance with the inventive principles of this patent disclosure. Further, well known processes have not been described in detail in order not to obscure the invention. Thus, while the invention is described in conjunction with the specific embodiments illustrated in the drawings, it is not limited to these embodiments or drawings. Rather, the invention is intended to cover alternatives, modifications, and equivalents that come within the scope and spirit of the inventive principles set out above.

What is claimed is:

1. A slot game device comprising:

one or more displays presenting a plurality of symbol locations forming a symbol array and presenting a progressive jackpot;

a user interface including at least one user input to enable a player to initiate slot game events presented via the symbol array;

a wager input device structured to identify and validate player assets, and to permit the player to play the slot game events when the player assets are provided; and a processor coupled to the one or more displays and configured to:

establish a monetary threshold;

guarantee awarding a progressive jackpot in a monetary range extending from below the monetary threshold to the monetary threshold;

cause the progressive jackpot to increase in value during the play of the slot game events and cause any one or more of the one or more displays to present the increasing value of the progressive jackpot to the player;

cause the progressive jackpot to be awarded at a monetary value in the monetary range extending from below the monetary threshold to the monetary threshold, and present the awarded monetary value of the progressive jackpot to the player via the one or more displays; and when the progressive jackpot has been awarded below the monetary threshold, maintain the progressive jackpot at its current monetary level and cause any one or more of the one or more displays to present the maintained current monetary level of the progressive jackpot to the player, and enable the progressive jackpot to continue to increase in value and cause any one or more of the one or more displays to present the value of the progressive jackpot to the player as it continues to increase;

when the progressive jackpot has been awarded above the monetary threshold, reset the progressive jackpot to a reset value and cause any one or more of the one or more displays to present the reset value of the progressive jackpot to the player.

2. The slot game device of claim 1, wherein causing the progressive jackpot to be awarded at the monetary value comprises comparing a game play variable to a predetermined condition, and causing the progressive jackpot to be awarded if the game play variable satisfies the predetermined condition.

3. The slot game device of claim 2, wherein:

the predetermined condition comprises a randomly-determined number of slot game events played, within a predetermined range of slot game events played, since a last award of the progressive jackpot;

the game play variable comprises a current number of the slot game events played since the last award of the progressive jackpot; and the processor is configured to cause the progressive jackpot to be awarded at the monetary value in response to the current number of slot game events played corresponding to the randomly-determined number of slot game events played.

4. The slot game device of claim 2, wherein:

the predetermined condition comprises a randomly-determined progressive jackpot value within a predetermined range of progressive jackpot values;

the game play variable comprises a current progressive jackpot value; and the processor is configured to cause the progressive jackpot to be awarded at the randomly-determined progressive jackpot value in response to the current progressive jackpot value reaching the randomly-determined progressive jackpot value.

5. The slot game device of claim 2, wherein:

the predetermined condition comprises an award date and time;

the game play variable comprises a current date and time; and the processor is configured to cause the progressive jackpot to be awarded at the current date and time in response to the current date and time corresponding to the award date and time.

6. The slot game device of claim 1, further comprising providing the monetary value to the player in response to the causing of the progressive jackpot to be awarded.

7. The slot game device of claim 1, wherein the processor is configured to cause the progressive jackpot to be awarded by causing the progressive jackpot to be awarded at or below the monetary threshold as a consequence of guaranteeing the progressive jackpot be awarded at or below the monetary threshold.

8. The slot game device of claim 1, wherein the processor is further configured to determine when the progressive jackpot has been awarded above the monetary threshold, and to reset the progressive jackpot to a new monetary value that is lower than the monetary value at the time that the progressive jackpot was awarded above the monetary threshold.

9. The slot game device of claim 8, wherein the new monetary value is a fixed monetary value that is less than the monetary value at the time that the progressive jackpot was awarded above the monetary threshold.

10. The slot game device of claim 8, wherein the new monetary value is a variable monetary value that is less than the monetary value at the time that the progressive jackpot was awarded above the monetary threshold.

11. A slot game device comprising:

one or more displays presenting at least a plurality of symbol locations forming a symbol array;

a user interface including at least one user input to enable a player to initiate slot game events presented via the symbol array;

a wager input device structured to identify and validate player assets, and to permit the player to play the slot game events when the player assets are provided; and a processor configured to:

provide at least one progressive jackpot that increases in value as the slot game events are played, and causing one or more of the one or more displays to present the value of the at least one progressive jackpot as it increases;

establish at least one condition where the progressive jackpot is guaranteed to be awarded;

cause the progressive jackpot to be awarded upon satisfaction of the condition;

enable the progressive jackpot to be awarded in response to triggering incidents during play of the slot game events; and when the progressive jackpot has been awarded in response to the triggering incidents during play of the slot game events, maintain the progressive jackpot at its current value and cause any one or more of the one or more displays to present the maintained current value of the progressive jackpot, and enable the progressive jackpot to continue to increase in value and cause one or more of the one or more displays to present the value of the progressive jackpot as it continues to increase.

12. The slot game device of claim 11, wherein the processor is further configured to reset the progressive jackpot to a reset value, and cause one or more of the one or more displays to present the reset value, in response to the processor causing the progressive jackpot to be awarded upon satisfaction of the condition.

13. The slot game device of claim 11, wherein the processor is configured to:

establish the condition as a randomly-determined number of slot game events played, within a predetermined range of slot game events played, since a last award of the progressive jackpot; and cause the progressive jackpot to be awarded in response to determining that a current number of slot game events played since a last award of the progressive jackpot has reached the randomly-determined number of slot game events played since the last award of the progressive jackpot.

14. The slot game device of claim 11, wherein the processor is configured to:

establish the condition as a randomly-determined progressive jackpot value within a predetermined range of progressive jackpot values; and cause the progressive jackpot to be awarded in response to determining that the current value of the progressive jackpot has reached the randomly-determined progressive jackpot value.

15. The slot game device of claim 11, wherein the processor is configured to:

establish the condition as an award date and time; and cause the progressive jackpot to be awarded in response to determining that a current date and time has reached the award date and time.

16. The slot game device of claim 11, wherein the processor is configured to provide a plurality of distinct ones of the progressive jackpots, each of which increase in value as the slot game events are played.

* * * * *